United States Patent [19]

Dubrow

[11] 4,445,275

[45] May 1, 1984

[54] DRAWING ASSEMBLY

[76] Inventor: David Dubrow, 4018 Cedarbrook Ct., Bellingham, Wash. 98225

[21] Appl. No.: 386,009

[22] Filed: Jun. 7, 1982

[51] Int. Cl.[3] ..... B43L 11/04

[52] U.S. Cl. ..... 33/30 R; 33/30 C; 33/30 G

[58] Field of Search ..... 33/30 R, 30 B, 30 G, 33/31, 30 C, 27 R, 27 B

[56] References Cited

U.S. PATENT DOCUMENTS

| | | | |
|---|---|---|---|
| 533,095 | 1/1895 | Starr | 33/30 R |
| 1,058,537 | 4/1913 | Bonner | 33/31 |
| 1,183,144 | 5/1916 | Wagner | 33/30 R |
| 4,174,572 | 11/1979 | Mikulin | 33/31 |

FOREIGN PATENT DOCUMENTS

| | | | |
|---|---|---|---|
| 1114989 | 5/1968 | United Kingdom | 33/31 |

*Primary Examiner*—Willis Little

*Attorney, Agent, or Firm*—Hughes, Barnard & Cassidy

[57] ABSTRACT

A drawing assembly configured for outlining the margin of a mat having a generally elliptical-shaped cut therein in a pattern replicating that of the cut, adapted for attachment to the mat cutting apparatus employed to make the cut, is comprised of a carriage slide member for adjustably securing a pen member at a selected location in cooperative engagement on a guide arm of a mat cutting apparatus, a pen member including a reservoir and a nib received in a stem member having a positioning arm thereon, a pen holder depending from the slide member including a barrel for receiving the stem member in axially reciprocable engagement therewith to permit the pen member to move between a lowered operating position and a raised non-operating position, a biasing member disposed within the barrel for biasing the pen member toward the operating position, and a locating member for guiding the nib when the pen member is in its operating position and the guide arm is set in motion.

14 Claims, 6 Drawing Figures

DRAWING ASSEMBLY

BACKGROUND OF THE INVENTION

1. Field of the Invention

The present invention relates, generally, to drawing assemblies useful for outlining the margin of a mat having a generally elliptical-shaped cut therein and, more especially, to such a drawing assembly which may be employed on the same apparatus used to make the cut in the mat so that the drawn outline replicates the contour of the cut including any slight deviations therein.

2. removed to expose that of the print while leaving a margin extending toward the periphery of the frame. Many people desire an ovate or elliptical treatment when framing such objets d'art. Usually an oval frame is employed; but sometimes a largeline the marginal area of the mat outwardly bounding the elliptical or ovate cut therein with one or more inked or drawn lines to enhance the aesthetic appearance of the treatment. Drawing such a marginal outline can be both tedious and time-consuming since the outline must replicate very closely both the shape and dimension of the elliptical cut in the mat, not to speak of the obvious fact that it must be accurately centered with respect thereto. This difficulty is further exacerbated since it is rare that the elliptical cut in the mat is mathematically "perfect". Even though one normally expects some minor deviation in the contour of the cut, usually the apparatus employed to make the cut will do so accurately enough that such deviations are imperceptible except upon very close scrutiny. However, were one then to outline that slightly imperfect ellipse using, e.g., a template or the like which is designed to yield nearly mathematically perfect shapes, the imperfections are magnified demonstrably. Accordingly, attempts to use templates, pantographs, or the like in order to provide the drawn outline are sorely disappointing from an artistic point-of-view.

Although scant if any attention has been paid to the problem of inking an outline of an elliptical cut in a mat used to mount objets d'art, many have proposed various apparatus for the drawing of ellipses. One conventional approach is the use of a pantograph where a pattern to be drawn is followed by a tracer joined through a linkage to a drawing pen which reproduces the movement and thereby transfers to the object substrate the shape of the traced design. Pantographs conventionally permit for both enlargement and reduction in the dimensions while generally holding the configuration in a relatively true reproduction. Many of these devices, due to the translation of movement, include a biased or spring-loaded drawing pen or instrument in order to maintain contact on in the dimensions while generally holding the configuration in a relatively true reproduction. Many of these devices, due to the translation of movement, include a biased or spring-loaded drawing pen or instrument in order to maintain contact with the substrate receiving the drawing. Among a variety of patented devices which are disclosed to be useful for drawing ellipses may be mentioned U.S. Pat. Nos. 2,504,832, 2,674,042, 2,810,960, and 4,014,101. However, none of those devices, some of which are rather elaborate in construction, are adaptable for the drawing of an ellipse within the context of the present invention as the same strive to provide perfect elliptical configurations which, as noted above, may well be undesirable when that ellipse is to be a border on a mat where the cut to be outlined is itself subject to some inherent deviation in conformity.

Accordingly, the need exists to provide a drawing assembly which is specifically configured to outline generally elliptically-shaped cuts in a mat where the outline replicates the elliptical cut including any minor deviations therein.

SUMMARY OF THE INVENTION

The present invention advantageously provides a highly efficient means to draw an elliptical outline in the marginal area of a mat surrounding an elliptical cut therein. The present invention is desirable for its ability to follow almost exactly any minor deviations in the elliptical cut imparted during the cutting technique so that the outline does not in any way enhance those deviations but, to the contrary, serves to mask the same.

These and other advantages are realized in a drawing assembly configured for outlining the margin of a mat having a generally elliptical-shaped cut therein in a pattern replicating that of the cut, which assembly is adapted for attachment to the mat cutting apparatus employed to make the cut so that any deviations imparted by virtue of the apparatus during the cutting technique are reproduced in the outlining technique as well. In a highly preferred embodiment of the present invention, the drawing assembly is comprised of carriage slide means for adjustably securing a pen member at a selected location in cooperative engagement on the guide arm of the mat cutting apparatus and a pen member in operative engagement therewith. As the guide arm of the cutting apparatus is caused to move about its elliptical path, the pen member accurately reproduces an elliptical outline at any desired location outwardly proximate the cut. The pen member, preferably one which includes a reservoir and gravity-fed nib, is received in a stem which is preferably disposed within a barrel secured to the slide means so that the stem may reciprocate within the barrel between a lowered operating position, where the nib is in contact with the mat, and a raised non-operating position out of engagement therewith. Preferably, the barrel includes a latch means and the stem includes a positioning lever means for engagement with the latch to maintain the pen in the raised, non-operating position. It is also preferred to include biasing means disposed internally of the barrel in order to bias the pen toward the operating position and to apply a generally uniform drawing pressure on the nib throughout the course of its elliptical path. Locating means are also preferably included to guide the nib during this course of travel.

In a highly preferred embodiment, one designed to accommodate a wide range of mat cutting apparatus, the drawing assembly also includes pitch adjustment means for regulating the angular pitch of the locating means and, thus, the pen during its course of travel. Under some circumstances, it has been found highly desirable to provide a slight angular pitch (a few degrees) along the direction of travel in order to provide for the uniform flow of ink through the nib. In turn, this helps insure a uniformity of line width about the ellipse and further enhances the aesthetic appearance of the finished product.

Other advantages and a fuller appreciation of the structure of the present invention will be gained upon a review of the detailed description which follows, taken in conjunction with the figures of drawing wherein:

DETAILED DESCRIPTION OF THE INVENTION

Figure 1:
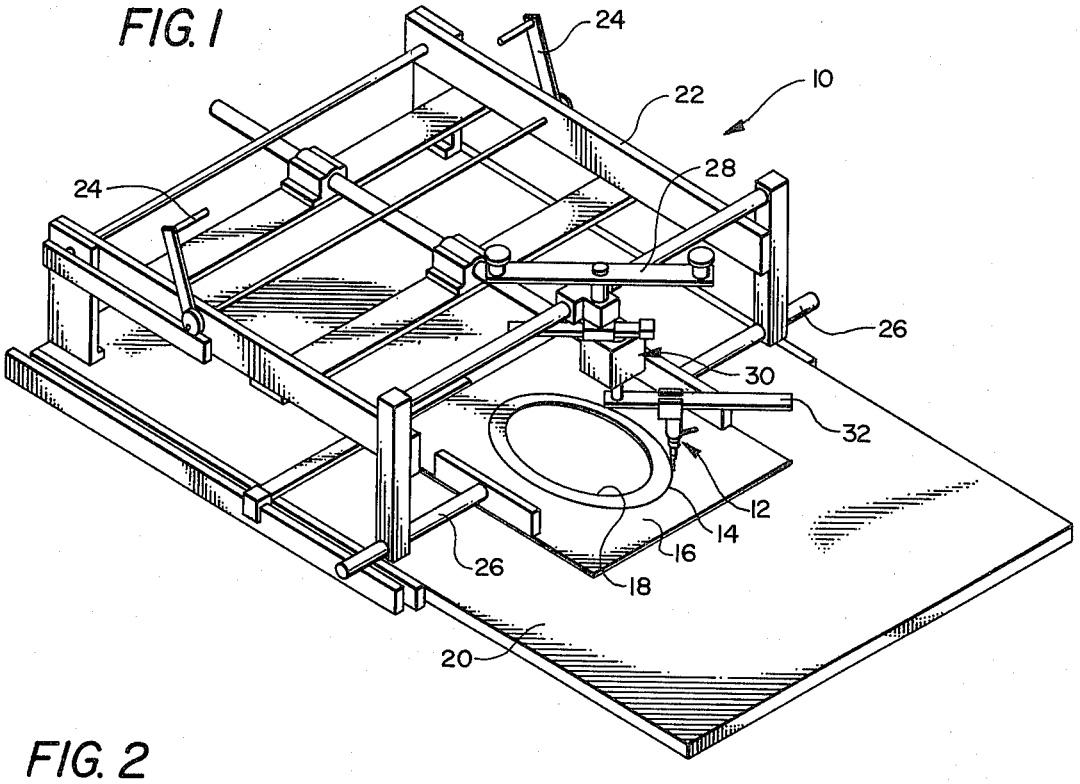
FIG. 1 is an isometric view of one type of mat cutting apparatus with which a drawing assembly of the present invention is associated.

The present invention relates to drawing assemblies in general, but more especially to drawing assemblies for association with apparatus employed for making elliptical-shaped cuts in a mat destined for mounting e.g., a print, whereby the elliptical cut may be aesthetically enhanced by the application of one or more elliptical lines drawn in the marginal area thereabout. Accordingly, the invention will now be described with reference to certain preferred embodiments within the aforementioned context; however, those skilled in the art will appreciate that such a description is meant to be exemplary and not limitative. For example, while the assembly of the present invention finds principal utility in the drawing of elliptical outlines, it is obviously equally well adapted for the null case—a circle—or other similar contours of interest.

Turning to the figures of drawing, in all of which like parts are identified with like reference numerals, FIG. 1 illustrates a mat cutting apparatus designated generally as 10 to which is secured a drawing assembly in accordance with the present invention, designated generally as 12, for the purpose of applying an elliptical outline 14 to a mat board 16 which has previously been cut to remove an elliptical segment 18. The mat cutting apparatus 10, while important for a complete understanding of the present invention, itself forms no essential part thereof. Accordingly, the structural features of mat cutting apparatus 10 will receive but scant attention herein. At this juncture, it should also be noted that there are quite a number of apparatus other than the one depicted which might be employed for cutting a mat and with which the drawing assembly of the present invention might find equal utility. Thus, any specific reference to the structure of the mat cutting apparatus 10 is made solely for the sake of illustrating the drawing assembly 12 in one of its intended environment.

Briefly stated, the mat cutting apparatus 10 includes a base 20 on which the mat board 16 is placed. An upper frame 22 is hingedly received in cooperative engagement with the support 20, and is moveable from a raised position to the lowered one shown by manipulation of handles 24. When in that lowered position, a pair of opposed arms or brace members 26 firmly restrain the mat board 16 on the support board 20. The brace members 26 are laterally adjustable to accommodate a fairly wide range of dimensions for mat members to be cut.

A rotatable arm 28 is connected through linkage means identified generally as 30 to a guide arm 32. Rotation of the arm 28 causes the guide arm 32 to describe an arcuate path. By appropriate adjustment of the linkage 30, this path might be circular or elliptical and have varying dimensions. When a cutting member is secured to the arm 32, in engagement with the mat 16, the mat will be cut in the pattern selected and governed by those adjustments.

Figure 2:
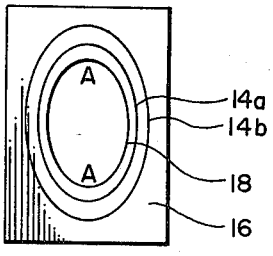
FIG. 2 is a top plan view of a mat having an elliptical cut therein and elliptical outlines thereof applied using the assembly shown in FIG. 1.

FIG. 2 shows the mat board 16 with an elliptical cut 18 therein, surrounded by a border comprising elliptical traces 14*a* and 14*b*. In some instances, the border might consist of but a single outline outwardly proximate the cut 18, in other cases a series of such outlines in a "concentric" array and where some may be thinner or thicker than others or of different colors. It should be appreciated that each such line must be centered on the cut 18 and each must replicate its contour as perfectly as possible. However, it is rare that the cut 18 itself will be a mathematically "perfect" ellipse; but will have some minor deviations from that type of perfection. Furthermore, it should be appreciated that the devices employed to cut the mat 16 have a tendency to apply non-uniform cutting pressure throughout the path of travel of the guide arm 32. For example, some devices apply somewhat greater cutting pressure about the edge corresponding to the major axis of the ellipse in the configuration of FIG. 2 (i.e., at the top and bottom of the cut 18 as shown at A—A) than across the minor axis. These variations in pressure and, perhaps, any loss of tolerance in the linkage as might be expected over extended periods of service, contribute to deviations in the contour of the ellipse 18. Were one to apply drawn elliptical outlines which themselves fail to account for these deviations, those in the cut contour 18 would be enhanced whereas otherwise they would be imperceptible except upon very close scrutiny. The drawing assembly 12 is designed to accommodate these facets of mat cutting machines.

FIGS. 3–6 illustrate a preferred form of the drawing assembly 12 which is designed to accommodate the aforementioned objectives. The drawing assembly 12 is comprised of a carriage slide means 40 for adjustably securing a pen member 42 in operative engagement with the guide arm 32 on the mat cutting apparatus 10. The slide means 40 is illustrated to be a generally rectangular block 44 having a channel 46 formed therein for sliding engagement on the arm 32. Accordingly, the channel 46 will be shaped and dimensioned as appropriate to mate with the arm 32, dictated of course by the shape and dimensions of the latter. A knob 48 or similar fastener is preferably included for securing the assembly 12 onto the guide arm 32 so that its positioning is maintained as the arm is rotated. It is also preferred to include an indicator 50, such as a pointer, for cooperation with any scale on the slide arm in order to insure accurate positioning and repositioning of the drawing assembly; a feature of considerable convenience when a plurality of elliptical traces are to be applied to the mat.

The pen member 42 is preferably comprised of a reservoir 52 and a gravity-fed nib indicated generally as 54. In the embodiment shown, the nib includes an ink-receiving channel or cavity 54 beneath the reservoir which leads to a generally cylindrical tip 58. The channel 56 terminates in a sealing face 60 with which may engage a reciprocable seal 62. The seal 62 terminates in a pin member 64 projecting through the cylindrical tip 58 and extending beyond the distal end thereof in the pen first in its raised, non-operating position and poised above the mat a desired location, it is then lowered by manipulation of the positioning arm 84 on the stem 70. When lowered, the pin 64 contacts the mat 16 and moves the sealing member 62 out of engagement with the seal 60 thereby permitting ink to flow through the cylindrical tip 58. Then, as the arm 28 is rotated in the normal fashion, the drawing assembly 12 follows the desired elliptical path, the dimensions of which are regulated by adjustment of the apparatus 10 in normal fashion. In some instances it will be found desirable to place a small piece of highly absorbent paper between the nib and the mat at the time the pen is lowered to absorb any initial excess of ink which might occur initially as a surge once the flow is established. In any event, as the pen moves about its path an ellipse will be drawn which replicates virtually identically the contour of the elliptical cut 18. As noted above, usually that cut is not mathematically perfect, but any slight deviations which result, for example, from the application of somewhat non-uniform pressures during the traverse of the guide arm 32, are accommodated by replication of those deviations in the drawn outline. Also, any non-uniform application of pressure on the pen member 42 is resolved principally by the biasing member 74 and, to a certain but lesser extent, by the floating action of the locating means 86. If during operation one encounters any slight drag on the pen, adjustment of the pitch regulating means 104 permits sufficient variation in the inclination angle of the nib of pen 42 to overcome this drag effect.

While the invention has now been described with reference to certain preferred embodiments, those skilled in the art will appreciate that various substitutions, modifications, and omissions may be made without departing from the spirit thereof. For example, minor structural adaptation may be required depending upon the design and operating characteristics of the mat cutting apparatus 10 employed. Accordingly, it is intended that the scope of the present invention be limited solely by that of the claims granted herein.

What is claimed is:

1. A drawing assembly configured for outlining the margin of a mat having a generally elliptical-shaped cut therein in a pattern replicating that of said cut, adapted for attachment to the mat cutting apparatus employed to make said cut, said drawing assembly comprising:

a. carriage slide means for adjustably securing a pen member at a selected location in cooperative engagement on a guide arm of a mat cutting apparatus;

b. a pen member, including a reservoir and a nib, received in a stem means for outlining a cut formed in a mat board by said mat cutting apparatus;

c. pen holder means depending from said slide means receiving said pen member in axially reciprocable engagement therewith, said pen member being reciprocable between a lowered operating position and a raised non-operating position;

d. biasing means for biasing said pen member toward said operating position; and, e. locating means in operative engagement with said carriage slide means, for guiding said nib when said pen member is in said operating position and said guide arm of said mat cutting apparatus is set in motion along a path replicating said outline.

2. The drawing assembly of claim 1, further comprising pitch adjustment means for regulating the angular pitch of said locating means.

3. The drawing assembly of claim 2, wherein said pen holder means comprises a barrel depending downwardly from said slide means within which is disposed said stem means and said biasing means.

4. The drawing assembly of claim 3, further comprising latching means for securing said pen member in said raised non-operating position.

5. The drawing assembly of claim 4, wherein said latching means comprises a notch in said barrel having non-axial circumferential component therein and a positioning arm extending outwardly of said stem means for cooperative engagement within said notch.

6. The drawing assembly of claim 2, wherein said locating means comprises a locating plate suspended from said slide means and having a locating aperture therein for guiding receipt of said nib.

7. The drawing assembly of claim 6, wherein said pitch adjustment means comprises spring means bridging said slide means and said locating plate for applying a lateral pitch adjustment force on the latter.

8. The drawing assembly of claim 7, wherein said spring means comprises a leaf spring secured to said slide means and projecting downwardly into engagement with an edge of said locating plate, said pitch adjustment means further comprising an adjustable spring stop on said locating plate for butting engagement with said leaf spring.

9. A drawing assembly configured for outlining the margin of a mat having a generally elliptical-shaped cut therein in a pattern replicating that of said cut, adapted for attachment to the mat cutting apparatus employed to make said cut, said drawing assembly comprising:

a. a carriage slide for adjustably securing a pen member at a selected location in cooperative engagement on a guide arm of a mat cutting apparatus;

b. a pen member, including a reservoir and a nib, secured in a generally cylindrical stem;

c. a pen holder depending downwardly from said slide, including a generally cylindrical barrel receiving said stem in axially reciprocable engagement therewith;

d. a pen biasing spring disposed within said barrel for applying a downward biasing force in said stem;

e. a locating plate suspended from said slide on a plurality of post members passing through slightly oversized apertures and terminating in adjustable fasteners permitting axial and pitch adjustment of said plate;

f. locating plate biasing springs disposed intermediate said slide and said plate for applying a downward biasing force on said plate.

g. an adjustable locating aperture in said locating plate for receiving said nib and guiding same during an outlining operation; and, h. a pitch adjustment spring secured to said slide and bearing against said locating plate for regulating the angular pitch thereof.

10. The drawing assembly of claim 9, wherein said locating plate includes an adjustable spring stop tab projecting outwardly therefrom for butting engagement with said pitch adjustment spring.

11. The drawing assembly of claim 10, wherein said adjustable locating aperture comprises a fixed aperture in said locating plate and a moveable aperture in a guide configuration shown in FIG. 5, which is a non-operating position. In that condition, any ink which flows from the reservoir 52 is trapped within the cavity 56 by virtue of the sealing engagement between the face 60 of the nib and the reciprocable seal 62. When the pen 42 is lowered to its operating position, as shown in FIG. 6, the pin member 64 contacts the surface of mat 16 thereby raising the sealing member 62 out of engagement with face 60 and, accordingly, permits ink within the channel 56 to flow outwardly of the tip 58.

The pen member 42 is disposed within a pen holder means designated generally as 66. In the embodiment illustrated, pen holder means 66 is comprised of a barrel 68 depending downwardly from the slide means 40. In this preferred embodiment, the pen member is secured within a stem means 70, disposed in axially reciprocable engagement interiorly of the barrel 68. The barrel is shown to be a generally cylindrical member as is the stem means 70, the latter having an outer diameter only slightly less of the inner diameter of the former so that it may reciprocate freely therein. The pen member 42 is engaged within the stem means 70 in threaded engagement as indicated generally at 72 so the pen may be removed from the stem in order to clean the pen components, resupply the reservoir, change to a different nib style etc.

Figure 6:
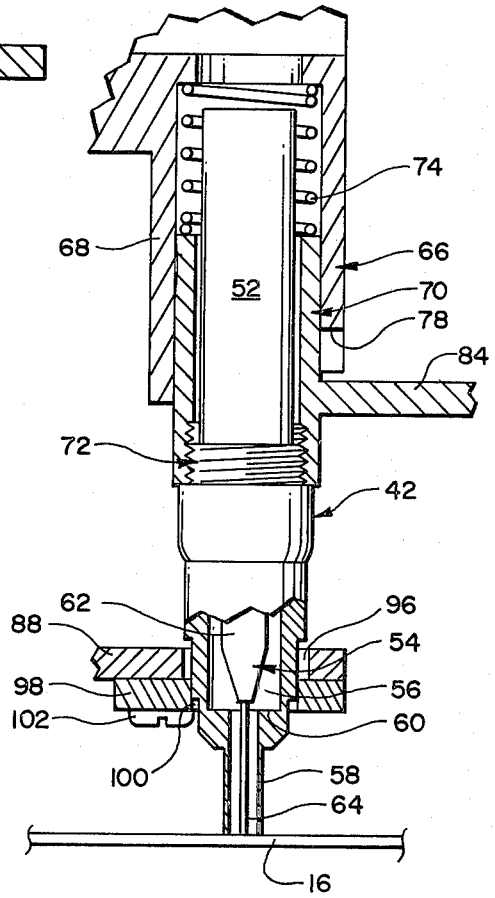

Biasing means 74 are disposed interiorly of the barrel 68 for applying a downward force on the pen member 42, urging the same toward its operating position shown in FIG. 6. In this embodiment, the biasing means 74 is a coil spring lodged intermediate the upper end of the barrel 68 and the top edge of the stem 70; albeit other configurations might be employed to this end. In order to maintain the pen member 42 in a raised, non-operating position in advance of the drawing procedure, latching means 76 are provided. In the embodiment shown, the latching means 76 is comprised of a notch 78 in the barrel 68 having a first axial leg 80 and a non-axial, circumferential leg 82, best viewed in FIG. 3. A positioning arm 84 extends outwardly of the stem means 70 for cooperative engagement within the notch 78. In the non-operating configuration shown in FIG. 5, the pen member 42 is raised and maintained in that position by engaging the positioning arm 84 into the leg 82. When it is desired to place the pen member 42 in its lowered operating position, the arm 84 is merely lifted out of engagement with the leg 82 and passed through the leg 80 allowing the pen member to drop to the position in FIG. 6. In that position, the pen biasing means 74 insures a relatively uniform pen pressure on the nib 54, irrespective of any variations in pressure applied to the assembly 12, as is anticipated under certain operating conditions as noted above.

The drawing assembly 12 includes locating means identified generally as 86 for guiding the nib of the pen member 42 when it is in its operating position and the guide arm 32 is set in motion about its path. In the preferred embodiment illustrated, locating means 86 is comprised of a locating plate 88 suspended from the slide means 40. The plate 88 is shown to be suspended from each of its corners by posts 90 which terminate in threaded fasteners 92 in order to adjust the position of the plate vis-a-vis the nib 54. Preferably, each of the posts 90 includes a biasing spring 94, extending between the bottom of the slide means 40 in the top of the plate 88, in order to bias the latter downwardly but permit a limited degree of "floating" movement of the plate during operation. Accordingly, it is preferred that the apertures in the plate 88 through which the posts 90 pass be somewhat oversized to allow for a limited degree of tilting for purposes described more fully hereinbelow.

The locating plate 88 includes a pen locating aperture 96 through which the distal end of the pen member 42 may project. The locating aperture 96 is configured both to locate and guide the nib during operation of the assembly, as best envisioned with reference to FIGS. 5 and 6. In order to provide for a modest degree of adjustability in this role, a guide aperture plate 98 is preferably secured beneath the locating plate 88. The guide aperture plate 98 itself includes an aperture 100 having a somewhat smaller diameter than the locating aperture 96 in the plate 88. The plate 98 is secured to the locating plate 88 by means of fixture members 102, which pass through oversized apertures into engagement with the locating plate 88. Consequently, the two apertures 96 and 100 may be registered as dictated by, e.g., the configuration of the nib of pen member 42 and, once positioned properly vis-a-vis one another, the fasteners 102 may then be secured to maintain that desired orientation.

Figure 3:
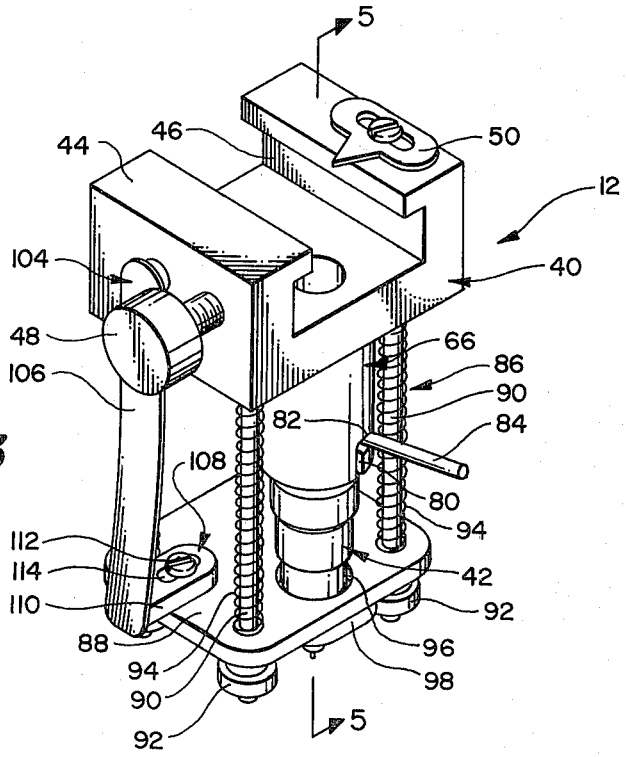
FIG. 3 is an isometric view of the drawing assembly of the present invention.
Figure 4:
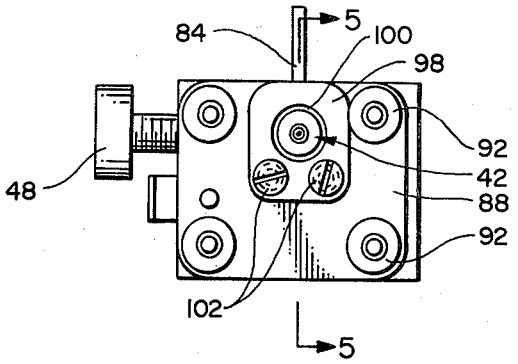
FIG. 4 is a bottom plan view of the assembly of FIG. 3.
Figure 5:
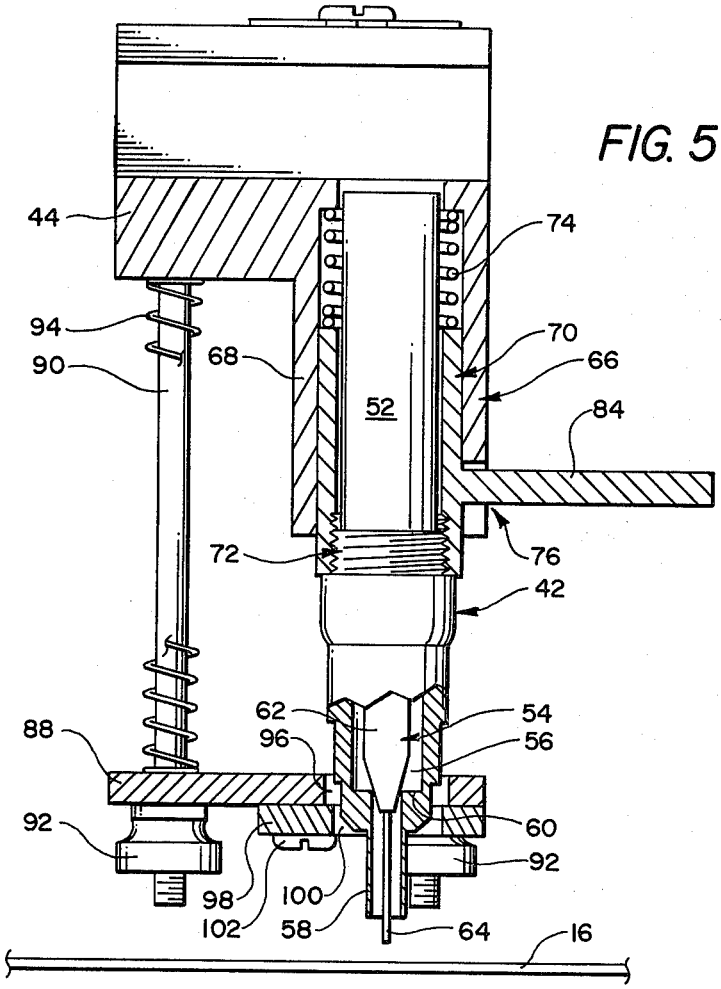
FIG. 5 is a sectional view taken substantially along the lines 5—5 of FIGS. 3 and 4, showing the nib in its raised position; and, FIG. 6 is a fragmentary, side view of the pen of the present assembly, shown in its lowered operating position.

Depending upon the pen member 42 employed in the drawing assembly 12 and the mat cutting apparatus 12, as well as its operational characteristics during a given outlining procedure, it is sometimes desirable to alter the pitch of the nib 54 during an outlining procedure. For this purpose, pitch adjustment means 104, best viewed in FIG. 3, are provided. The pitch adjustment means permit slight regulation of the angle of inclination of the locating plate 88 by applying a slight lateral pressure thereto. In many cases it will be desirable to incline the nib a few degrees toward the direction of travel and, accordingly, the pitch adjustment means are best located on the rear side of the assembly 12 (i.e., that away from the direction of travel). By appropriate adjustment of the lateral force on the plate 88 and its relative positioning vis-a-vis the slide 40, the latter of which is best accommodated by means of the nuts 92, a suitable pitch adjustment can be achieved.

In the preferred form shown in FIG. 3, pitch adjustment means 104 is comprised of a leaf spring 106 secured at its proximal end to the slide 40 and engaging the plate 88 at its free distal end in butting contact with an adjustable stop means identified generally as 108. The adjustable stop means 108 is shown to be comprised of a tab 110 secured to the plate by a fastener 112. Fastener 112 passes through an elongated slot 114 so that the tab 110 may be moved inwardly or outwardly with respect to the spring 106 thereby altering the effective force applied to the plate 88.

In operation, the drawing assembly 12 of the present invention simply and efficiently provides means for applying an outline in the margin of mat 16 replicating very closely the contour of the elliptical cut 18 previously formed therein. That cut is established by engaging a cutting element, such as a knife, on the guide arm 32 at a desired location and rotating the arm 28 to scribe and eventually cut the elliptical opening in the mat. The cutting member is then removed and replaced by the assembly 12 which is positioned on the guide arm 32 at any desired location. Usually the guide arm 32 will include a scale permitting for accurate positioning of the assembly 12 and, where a series of "concentric" ellipses are to be applied in the margin, the scale also facilitates accurate repositioning in order to maintain a desired spacing between individual outlines. With the aperture plate secured to said locating plate and adjustable with respect thereto.

12. In combination with a mat cutting apparatus, a drawing assembly including a carriage means, biased pen member disposed on said carriage means, a locating plate depending from said carriage means having a guide aperture therein through which the lower end of said pen passes in guiding receipt therewith, and means bridging said carriage means and said locating plate for adjustably regulating the pitch of said locating plate.

13. The combination of claim 12, wherein said locating plate is suspended beneath a slide member for securing said assembly to said apparatus, and further wherein said means for regulating the pitch of said locating plate comprises spring means for applying a transverse force on the trailing edge of said locating plate.

14. The combination of claim 13, wherein said spring means comprises a leaf spring secured at a fixed end to said slide member and disposed against said locating plate at a free end in butting engagement with an adjustable spring stop means for regulating said force.

* * * * *